US008351835B2

(12) United States Patent
Maruyama

(10) Patent No.: US 8,351,835 B2
(45) Date of Patent: Jan. 8, 2013

(54) TUBE AND METHOD FOR MANUFACTURING THE SAME

(75) Inventor: Katsutoshi Maruyama, Tsubame (JP)

(73) Assignee: K. K. ENDO Seisakusho, Tsubame-shi (JP)

( * ) Notice: Subject to any disclaimer, the term of this patent is extended or adjusted under 35 U.S.C. 154(b) by 293 days.

(21) Appl. No.: 12/739,170

(22) PCT Filed: Oct. 14, 2008

(86) PCT No.: PCT/JP2008/068542

§ 371 (c)(1),
(2), (4) Date: Apr. 22, 2010

(87) PCT Pub. No.: WO2009/060692

PCT Pub. Date: May 14, 2009

(65) Prior Publication Data

US 2010/0226698 A1 Sep. 9, 2010

(30) Foreign Application Priority Data

Nov. 5, 2007 (JP) ..... 2007-286963

(51) Int. Cl.
*G03G 15/20* (2006.01)

(52) U.S. Cl. ..... 399/333; 72/85; 492/18

(58) Field of Classification Search ..... 399/159, 399/328–333; 29/17.1, 17.2, 17.8, 428, 516, 29/895; 72/85, 340.14, 370.25; 492/18, 492/57, 58

See application file for complete search history.

(56) References Cited

U.S. PATENT DOCUMENTS

| | | | | |
|---|---|---|---|---|
| 4,611,902 | A * | 9/1986 | Schon | 399/328 |
| 6,898,397 | B2 * | 5/2005 | Sakuma et al. | 399/159 |
| 2001/0007846 | A1 | 7/2001 | Sakuma et al. | |
| 2002/0104351 | A1 | 8/2002 | Sakuma et al. | |

FOREIGN PATENT DOCUMENTS

| | | | |
|---|---|---|---|
| JP | 2001-5322 | A | 1/2001 |
| JP | 2001-109306 | A | 4/2001 |
| JP | 2001-159857 | A | 6/2001 |
| JP | 2001225134 | A | 8/2001 |
| JP | 2003-45615 | A | 2/2003 |
| JP | 2005-345997 | A | 12/2005 |
| JP | 2006-267408 | A | 10/2006 |

OTHER PUBLICATIONS

International Search Report of PCT/JP2008/068542, mailing date of Dec. 9, 2008.

* cited by examiner

*Primary Examiner* — Hoan Tran
(74) *Attorney, Agent, or Firm* — Westerman, Hattori, Daniels & Adrian, LLP

(57) ABSTRACT

There is provided a tube having fine irregularities formed on the outer peripheral face or inner peripheral face. The tube has a hollow tube body made of metal with uniform wall thickness of 20 to 50 μm. The tube is obtained by plastic working through spinning, in which a metallic ring-shaped metal original body (6) is rotated together with a rotation support body (3) about the center axis of the metal original body (6), while being pressed by a top or tops (5) disposed on the outer periphery of the metal original body (6). Fine irregularities (12) are formed on the outer peripheral face or the inner peripheral face of the metal tube at a substantially fixed interval. Both ends of the metal original body (6) worked by spinning are cut to yield a tube (11).

3 Claims, 4 Drawing Sheets

TUBE AND METHOD FOR MANUFACTURING THE SAME

FIELD OF THE INVENTION

The present invention relates to a tube, which is used in fixing rollers or the like in electrophotographic printers and copiers, and to a method for manufacturing such a tube. More particularly the present invention relates to a tube that is manufactured through spinning and used in fixing rollers or the like and to a method for manufacturing such a tube.

BACKGROUND OF THE INVENTION

Metal tubes having a through-hole formed in the center are used, for instance, as fixing tubes in laser beam printers and the like. The fixing tube varies in its manner of use depending on whether it is used in monochrome copiers, color copiers, color printers or the like. In a widely employed method in monochrome copiers, for instance, images, characters and so forth are fixed by fixing toner onto paper by way of a heated roller (fixing roller). The fixing roller for carrying out such fixing is ordinarily a thin-walled metal tube, the surface of which is covered or coated with a fluororesin.

Disclosed methods for manufacturing metal tubes involve plastic working of a metal sheet. The applicants have proposed a plastic working technology for metal tubes in which a thin-walled metal tubular body is processed by plastic working, specifically by spinning (for instance, Japanese Patent Application Laid-open No. 2004-174555; Patent document 1). A thinner-walled tube is advantageous in that preheating of the tube takes less time when the tube used, for instance, as a fixing roller of a copier. In this regard, therefore, the tube is preferably as thin as possible, so long as the necessary mechanical strength is not impaired thereby. In a tube-making technology in which a metal tube is covered with a fluororesin, a fluorine tube for fixing members has also been proposed in which axial shrinkage ranges from 1 to 8% and radial shrinkage ranges from 2 to 8% upon heating at 150° C.

The fixing tube manufactured in accordance with the present invention is ordinarily used, for example, in a copier, as follows. An image is exposed on a photosensitive drum whose surface electric resistance changes when irradiated with light, to form an electrostatic latent image on the drum. Toner, which is a magnetic powdery ink, is caused to adhere to the electrostatic latent image, to yield an image having toner adhering thereonto. The image with toner adhering thereonto is transferred to paper.

In transfer, the back of the paper is imparted positive charge by a transfer roller, whereupon the toner on the surface of the photosensitive drum is transferred to the paper. After transfer, the paper is separated from the photosensitive drum and the image having that transferred toner adhering thereon in an unfixed state is heated by a fixing tube (fixing roller) to soften the toner. The toner is fixed by pressing, to complete image copying. The method for manufacturing a tube according to the present invention is a method for manufacturing a tube for a roller, for instance, a fixing roller used in the above copying process.

It is required that the transfer rollers, fixing rollers and the like have better performance in terms of, for instance, facilitating separation between paper and rollers after transfer and fixing under high speed operation and ensuring reliable fixing, taking deformation during use of a copier in consideration.

Conventional processing methods, however, do not contemplate a process of forming a below-described spiral pattern on the outer peripheral face of the metal tube. No technologies have been disclosed in which a spiral pattern can be imparted to a thin-walled metal tube during ordinary working, without subjecting the metal tube to a supplementary process.

As described above, a fixing roller is formed by covering a metal tube with a resin as a coating material. The surface of the fixing roller is deformed readily, through expansion and contraction, when heated during use, particularly in the case of thin-walled rollers. Such fixing rollers are exposed to harsh conditions in use, for instance by heating, and yet must be durable, while problems such as deformation of fixing roller and peeling of the coating material should not occur no matter how harsh the conditions in use may be. In other words, the coating material must cover the metal tube securely.

In general, the coating depends on the shape of the metal tube. Specifically, a concave surface on the outer periphery of the metal tube results in a concave shape in the finished article after coating, while a convex surface of the metal tube results in a convex shape in the finished article after coating. When the metal tube is thin-walled, however, it is difficult to preserve at all times, for example, concave shape of the surface of the metal tube.

The above conventional technologies were problematic, in particular, as regards mass production of stable articles. Ideally, the outer peripheral face and/or inner peripheral face of the metal tube should be shaped as having fine irregularities at a fixed interval, i.e. should be shaped in a spiral pattern, regardless of the thinness of the metal tube wall. Development of such a tube and of a method for manufacturing such a tube has been desired.

SUMMARY OF THE INVENTION

The present invention, which has been created with a view of solving the above conventional problems, achieves the following objects.

An object of the present invention is to provide a tube in which a stable spiral-pattern shape can be securely imparted through spinning of a thin-walled metal tube.

A further object of the present invention is to provide a method for manufacturing a tube that allows manufacturing a tube having a spiral-pattern formed thereon at low cost.

The present invention attains the above objects by way of the means as stated below.

In the first aspect of the present invention, a tube is provided that is a hollow tube made of metal, having a uniform wall thickness of 20 to 50 μm and being obtained by plastic working through spinning, in which a metallic ring-shaped metal original body is rotated about the center axis thereof together with a rotation support body, while being pressed by a top or tops disposed on the outer periphery of the metal original body, wherein fine irregularities are formed on the outer peripheral face and/or the inner peripheral face of the metal tube at a substantially constant interval.

In the second aspect of the present invention, the tube according to the first aspect of the invention is provided, wherein the irregularities are formed in the shape of multiple spirals in the center axis direction of the metal tube.

In the third aspect of the present invention, the tube according to the first or second aspect of the invention is provided, wherein said tube is a tube for a fixing roller or for a belt used in an electrophotographic printer or a copier.

In the fourth aspect of the present invention, a method for manufacturing a tube is provided, which comprises a step of mounting a metal original body of a plastic-workable metal on a rotation support body for working the metal original body to have an inner-outer surface configuration with fine irregularities at a substantially constant interval; a step of subjecting the mounted metal original body to spinning, in which a wall thickness of a tubular portion of said metal original body is reduced to a uniform wall thickness of 20 to 50 μm while the metal, original body is rotated about the center axis thereof together with the rotation support body and in which the inner-outer surface configuration of the metal original body becomes a surface with fine irregularities at a substantially constant interval; and a step of cutting both end portions of the metal original body, having been subjected to spinning, to yield a tube shape.

In the fifth aspect of the present invention, the method for manufacturing a tube according to the fourth aspect of the invention is provided, wherein a material of said metal original body is stainless steel.

In the sixth aspect of the present invention, the method for manufacturing a tube according to the fourth aspect of the invention is provided, wherein the surface with the fine irregularities is a surface having indentations of fine irregularities in a pattern of multiple spirals.

As explained above, the method for manufacturing a tube according to the present invention allows forming fine irregularities the tube at the stage of working by spinning. This allows, as a result, simplifying the manufacturing process, since the flow of subsequent processes, such as blasting, coating and so forth, is identical to a conventional process flow. The invention allows thus reducing manufacturing costs vis-à-vis conventional methods. The method for manufacturing a tube is particularly appropriate for thin-walled tubes, where the method allows forming fine irregularities having a spiral pattern.

The tube according to the present invention has fine irregularities with a spiral pattern formed thereon by spinning. Here, the tube has a similar pattern of fine irregularities formed on the outer peripheral face as well as on the inner peripheral face. The fine irregularities on the inner peripheral face of the tube can hold a lubricant or the like. The fine irregularities having a spiral pattern elicits the effect of providing lubricant-holding capability.

DETAILED DESCRIPTION OF PREFERRED EMBODIMENTS

Embodiments of the tube and method for manufacturing the tube according to the present invention will be explained in detail below.

Figure 1:
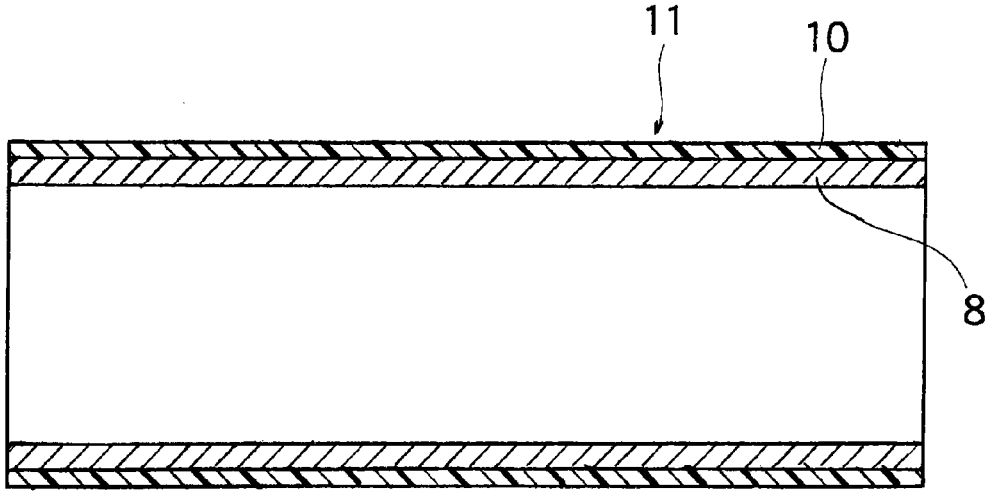
FIG. 1 is across-sectional view of a tube illustrating the features of the present invention.
Figure 2:
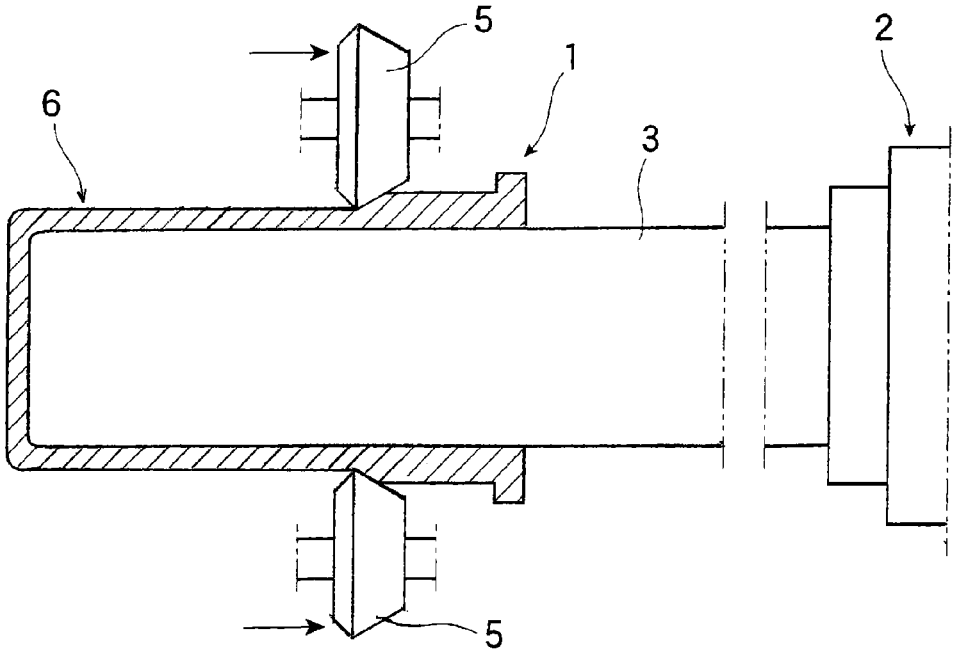
FIG. 2 is a view for explaining a process in which a metal original body is worked by spinning.
Figure 3:
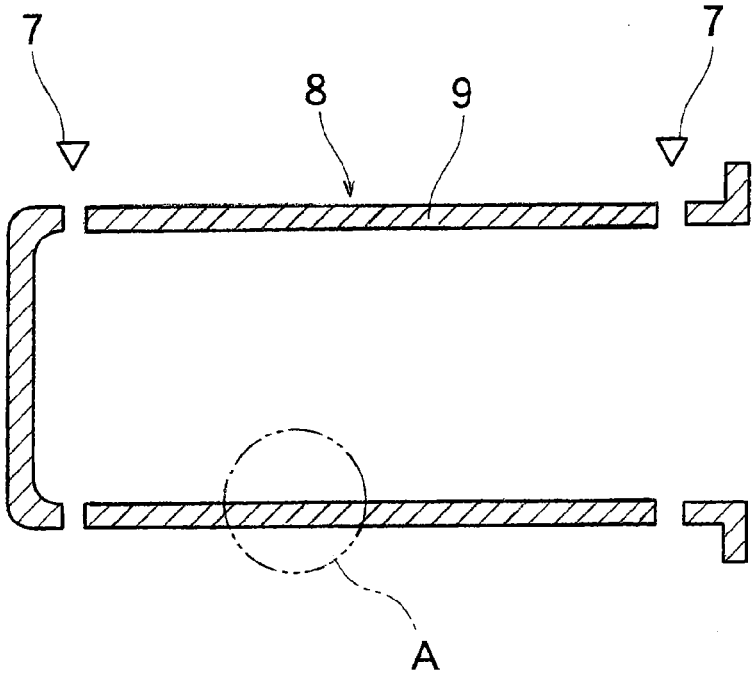
FIG. 3 is a view for explaining a process in which a spun metal original body is cut into a metal tube.

FIG. 1 is a cross-sectional view illustrating a tube manufactured in accordance with the method for manufacturing the tube according to the present invention. FIG. 2 is a view for explaining a process in which a metal original body, as metal prime tube, is worked through spinning. FIG. 3 is a view for explaining a process in which a metal original body formed through spinning is cut into a metal tube. Spinning work on the metal original body, which is the original body of the metal tube, will be explained first.

Working by spinning itself is disclosed in Patent document 1 by the present applicants, while the embodiments are based on the working technology disclosed therein. Here, to facilitate comprehension of the embodiments of the present embodiment, a method for manufacturing a tube will be explained combining the method according to the present invention and a conventional method. A bottomed prime tube 1, pre-worked beforehand out of a metal thin sheet by pressing or the like, is further thinned with a spinning machine 2.

Although not shown, the bottomed prime tube 1 is manufactured by pressing a metal thin plate between a female die and a punch. The deeper the bottomed tube stock 1 is, the easier the subsequent spinning process becomes. During pressing, therefore, the bottomed prime tube 1 is formed by plastic working, such as by warm deep drawing with the punch cooled and the female die heated or by cold deep drawing. The metal thin sheet is of stainless steel, for instance SUS304 (corresponding to AISI 304). Other than stainless steel, the metal thin sheet may also be an aluminum alloy, nickel, iron or the like.

As illustrated in FIG. 2, the bottomed prime tube 1 pressed beforehand is rotated while being inserted into and clamped by a rotary mandrel 3 of the spinning machine 2. The rotary mandrel 3 is also a die body that defines the shape of the bottomed tube stock 1. In the spinning process, a thin-walled bottomed prime tube 1 is forcibly drawn along the outer peripheral face of the rotary mandrel 3, to form the metal original body 6 that yields the metal tube 8. The portion at which the rotary mandrel 3 and the bottomed tube stock 1 come into contact with each other is a so-called mandrel.

The bottomed prime tube 1 is attached, through insertion, onto the rotary mandrel 3 having the above configuration. A plurality of conically-shaped tops 5 is disposed around the outer periphery of the bottomed prime tube 1 spaced apart by equal angle intervals. In this state, the tops 5 are brought into contact with the outer peripheral face of the bottomed prime tube 1 and are caused to move in the direction of the arrow (direction of rotation center axis) under application of a uniform, constant pressure, while the bottomed prime tube 1 is rotated. Both ends of the bottomed prime tube 1 are stiffer than the central portion 9. The bottomed prime tube 1 is gradually squeezed, through compression by the tops 5 moving along the tubular portion, whereby the bottomed prime tube 1 becomes longer in the center axis direction with its wall becoming thinner. The tops 5 are a kind of rotatable tool shaped in a conical form such as an abacus bead.

As the tops 5 move along the center axis direction of the bottomed prime tube 1 during the spinning process, the worked face of the bottomed prime tube 1 becomes unevenly shaped, with indentations in a spiral pattern, as described below. The characterizing feature of the spinning process is the reduction in wall thickness that it affords. The shape halfway during working, at the stage of the bottomed prime tube 1, may exhibit a wall thickness of 20 to 50 μm, as is the case in the present embodiment.

In the present embodiment, the wall thickness of the metal original body 6 can be reduced by subjecting the bottomed prime tube 1 made of plastic-workable metal to a spinning process and, along with this, indentations in the form of spiral-pattern irregularities can be formed thereon.

In the case of stainless steel SUS304, the spinning process is carried out by warm drawing, with the critical drawing ratio increased to 2.6. In the case where the spun metal original body 6 is made of stainless steel SUS304, the tensile strength thereof is 1666 MPa (170 kgf/mm$^2$) and, although contingent on differences in conditions, fatigue strength is not lower than 980 MPa (100 kgf/mm$^2$). When the resulting thin-walled metal original body 6 is thus obtained through spinning, the resulting thin-walled metal original body 6 is removed from the rotary mandrel 3.

The metal original body 6 is pulled out of the rotary mandrel 3. Then, the removed metal original body 6, having been worked to be of above mentioned thickness, is cut at both ends by a cutting tool 7 as shown in FIG. 3.

The barrel of the central portion 9 thus cut constitutes the metal tube 8 of a fixing roller or the like. Thereafter, the metal tube 8 may be subjected to low-temperature annealing at a temperature of about 450° C., to adjust springiness, relieve internal stresses and achieve a uniform shape. Low-temperature annealing has the effect of increasing the hardness, tensile strength and fatigue strength of the metal tube 8.

Figure 4:
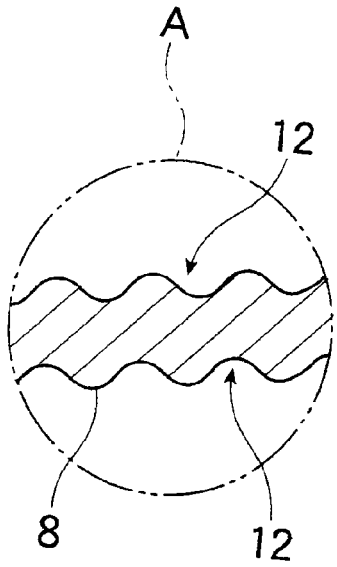
FIG. 4 is an enlarged view of portion A in FIG. 3, which illustrates the cross-sectional shape of indentations of fine irregularities having a spiral pattern.

Spiral-pattern indentations 12 are formed, as illustrated in FIG. 4, on the surface of the metal original body 6 in the spinning process of the metal tube 8. The indentations 12, which are formed through displacement of the tops 5 in its pressure contact with the surface of the metal original body 6, comprise an uneven surface in which fine unevenness (irregularities) is regularly formed at a given interval on the outer peripheral and inner peripheral faces of the metal original body 6. The spiral pattern is created as marks of the indentations formed by spinning with the tops 5. Thus, a regular fine uneven surface is formed in a multiple spiral pattern, on the outer peripheral face of the metal tube 8, by way of the tops 5. The number of spiral patterns varies depending on the number of tops 5. For instance, a regular fine uneven surface formed by three tops 5 is made up of triple spiral patterns.

Since the metal original body 6 is a tube with thin wall, the indentations 12 are formed on the outer peripheral face side and the inner peripheral face side of the metal original body 6. The formation of the indentations 12 as a regular fine uneven surface elicits an important technical effect when the metal original body 6 is used in an article such as a roller or the like. In a case where the metal original body 6 is used in a fixing roller of a copier, for instance, a high-frequency heater for heating is incorporated into the inner hole of the fixing roller. Lubricant is supplied for lubrication between the inner peripheral face of the fixing roller and the high-frequency heater during rotation of fixing roller. The lubricant is accumulated in the indentations 12 of the inner peripheral face of the fixing roller, so that the high-frequency heater slides smoothly on the inner peripheral face of the fixing roller.

The basic manufacture in the present invention has been set forth in the above embodiment. To obtain a finished-article as a tube 11, however, further processes are carried out, such as blasting, coating and the like. During these finishing processes, the wall thickness dimensions and shape of the metal tube 8 remain unchanged. The related processes are outlined below, which are explained in detail in Patent document 1. A blasting treatment, for instance, a sandblasting treatment, is carried out first for the metal tube 8, whose hardness, tensile strength and fatigue strength have been increased to a certain extent as described above.

The sandblasting treatment is carried out in order to increase the area of the surface of the metal tube 8 through the formation of irregularities and to activate the surface. Residual compressive stress is generated as a result on the surface to increase fatigue strength. Shot peening is ordinarily carried out as a sandblasting treatment. Both ends of the metal tube 8 are supported on chucks respectively and the metal tube 8 is made to be rotated in a predetermined direction at predetermined revolutions.

A fine spherical abrasive (shot) is blown onto the surface of the metal tube 8 through nozzles that can move vertically. That is, irregularities are formed on the surface by blowing a fine spherical abrasive (shot) onto the surface, while the resulting impact relieves residual tensile stress and increases residual compressive stress. The irregularities formed on the surface on account of the abrasive (shot) increase the area of the surface by making the latter rougher. This has the effect of increasing adhesiveness in a below-described coating process.

The sandblasting treatment is applied to the metal tube 8 that results from cutting both ends of the metal original body 6 with wall thickness of 20 to 50 μm formed through the above-described spinning work. In the present embodiment, as described above, the process of imparting residual compressive stress and the process of surface roughening are carried out simultaneously in the sandblasting treatment. These two processes, however, may be carried out separately. For instance, surface roughening may be carried out by way of, for instance, polishing or treatment with laser.

The metal tube 8 thus subjected to a surface treatment is then coated as explained below. The coating material 10 used in the coating treatment is a fluororesin. Coating is performed by heating the coating material 10 on the surface of the metal tube 8 to elicit thermal shrinkage of the coating material 10. The coating layer, for which coating treatment has been carried out, serves as a protective layer of the metal tube 8 and has a constant thickness. Therefore, the spiral pattern shape of the tube 11 does not change through coating of the metal tube 8. The coating, moreover, protects the surface of the metal tube 8 against oxidation.

The coating has a function of facilitating release of the copier paper when the latter is wrapped around the metal tube 8 and also a function of averting formation of wrinkles. The fluororesin used for the coating material 10 is a polymer that can be shaped thermoplastically, where materials superior in shaping ability and heat resistance may be such as a bipolymer of ethylene and trifluorochloroethylene or a bipolymer of tetrafluoroethylene and a perfluoroalkyl vinyl ether. Other than a fluororesin, the coating material 10 may also be a silicone layer and a fluorocarbon resin layer formed on the silicone layer.

In the coating treatment it is essential that the coated fluororesin should not be peeled off the metal tube 8. Shot peening is carried out in the present embodiment in order to roughen the surface of the metal tube 8. This surface roughening has the dual purpose of increasing the residual compressive stress in the metal tube 8 and, at the same time, imparting surface roughness for preventing detachment of the coating layer.

The process for imparting surface roughness is preferably applied to stainless steel, while it may be applied to other metals. Thus, the rough surface resulting from sandblasting (shot peening) is coated thereafter, as a result of which it is possible to reduce the occurrence of "wrinkles" and "cracks" that arise from differences in thermal shrinkage and that are a problem in conventional practice. The final result is the coated tube 11 illustrated in FIG. 1. This finished article may come under other denominations such as fixing roll, pressure roller, heating roller, paper feeding roller, photosensitive drum and the like.

The metal tube 8 described above is formed through spinning of the metal original body 6. The metal original body 6 is a bottomed prime tube 1 obtained by drawing of sheet stock. In addition to being obtained by the above processes, however, the metal original body in the present embodiment may also be manufactured, for instance, by turning, polishing, plating or the like.

WORKING EXAMPLES

Next, it was inspected that the spiral pattern indentations are formed on the surface of a metal tube 8 obtained through spinning of a bottomed prime tube 1 made of plastically workable metal.

The material of the metal original body 6 is SUS304, an austenitic stainless steel. Spinning is carried out with three tops 5 disposed around the outer periphery of the metal original body 6 so as to be spaced apart by an equal angle of 120 degrees. To perform spinning of the metal original body 6, the tops 5 are caused to move at a predetermined speed while the bottomed prime tube 1 is rotated at predetermined revolutions.

Figure 5:
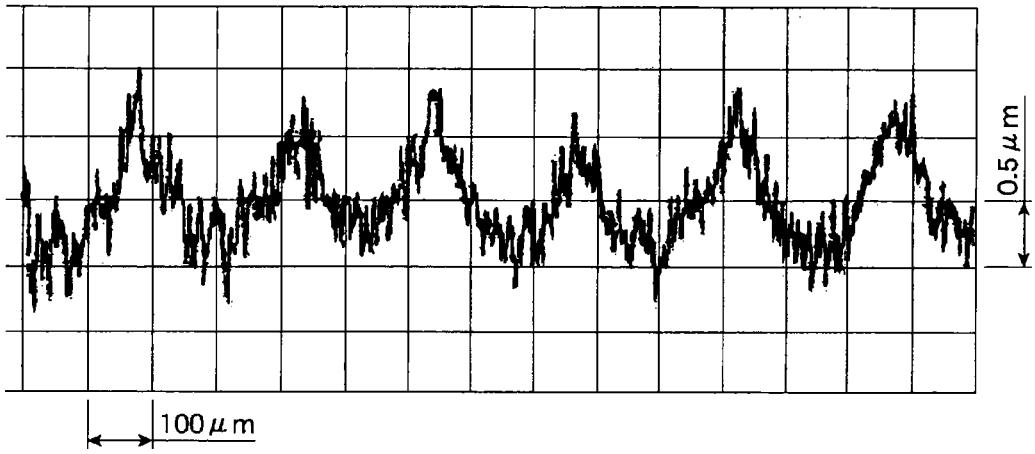
FIG. 5 is a data diagram illustrating a surface shape in which indentations of a fine unevenness having a spiral pattern is formed in the vicinity of a flange of a metal tube.
Figure 6:
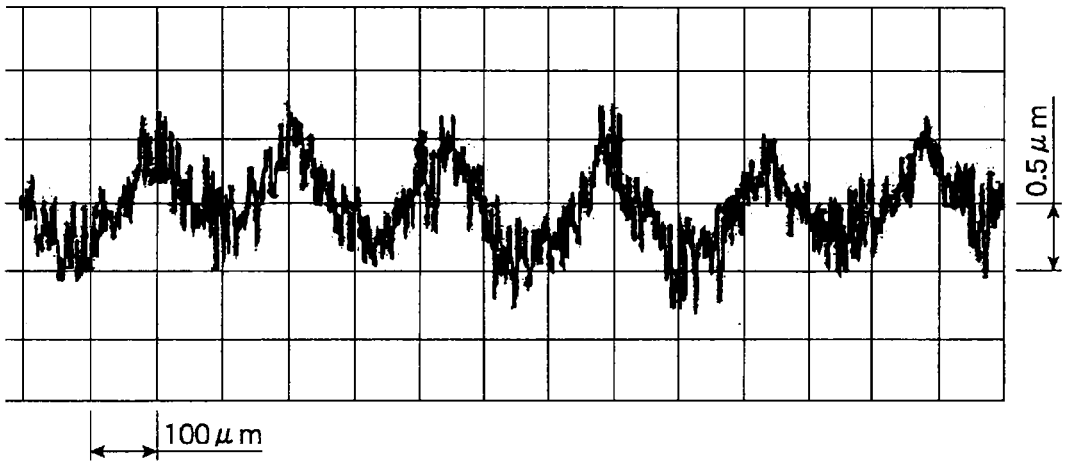
FIG. 6 is a data diagram illustrating a surface shape in which indentations of fine irregularities having a spiral pattern is formed in the vicinity of the bottom of a metal tube.

The surface configuration of the metal tube 8 was measured using a surface roughness-profile measuring device Surfcom 130A by Tokyo Seimitsu (Tokyo, Japan). The surface roughness-profile measuring device was used to measure whether spiral pattern indentations were formed on the surface of the metal tube 8. In the measurement, a probe is caused to move at a predetermined speed along a direction parallel to the center axis direction of the metal tube 8. The probe moves by being guided along a straight plane with high precision. FIGS. 5 and 6 illustrate the surface configuration in magnification of 20000 times in the vertical direction (vertical axis scale: 0.5 μm/10 mm) and 100 times in the horizontal direction (horizontal axis scale: 100 μm/10 mm). That is, the surface configuration is shown so as to be magnified by 200 times in the vertical direction with respect to the horizontal direction.

FIG. 5 illustrates measurement results for the vicinity of the flange portion of the metal tube, i.e. a portion in the range of 15 mm from the right end in FIG. 3. The measurement results of surface configuration illustrate, in a magnified manner, the amount of variation (in vertical direction in FIG. 5) of the surface profile curve (cross section curve) of the metal tube 8 over a predetermined measurement length (in horizontal direction in FIG. 5) along the center axis direction of the metal tube 8, i.e. the irregularities of the surface (peaks and valleys of the actual surface). The surface state (surface configuration) of the metal tube exhibits indentations in which a fine shape of protrusion and depression is repeated regularly at constant intervals. This indicates that the surface configuration of the metal tube 8 is the result of the formation of indentations made up of fine irregularities with a spiral pattern. That is, it was verified that the surface of the spun metal tube 8 has indentations in the form of fine irregularities with a spiral pattern formed thereon.

FIG. 6 illustrates measurement results for the vicinity of the bottom portion of the metal tube 8, i.e. a portion in the range of 15 mm from the left end in FIG. 3. As in the case in FIG. 5, the surface configuration of the metal tube exhibits indentations in which a fine shape of protrusion and depression is repeated regularly at constant intervals.

Since the surface profile curve (cross section curve) is uneven in all cases, the unevenness was expressed as the dimension difference between peaks and valleys in the surface shape curve, which was of about 1 μm. When the finished article of the metal tube is used, for instance, as a fixing roller or the like, the fine irregularities afford a very significant effect in that it has the function of holding lubricant, in particular, on the inner face of the tube.

Besides the metal tube explained in the present working example, measurement was made for the surface configuration of other spun metal tubes, using a surface roughness-profile measurement device. Although the results are not illustrated herein, the surface configuration of these other metal tubes was similar as that of the working example. In other words, it was found that spinning yields indentations having fine unevenness with spiral pattern.

Comparative Examples

A metal tube was manufactured by gradually reducing the wall thickness of the tube through repetition of conventionally used working processes such as drawing, annealing or the like. Measurement was made for the surface configuration of the thin-walled metal tube thus manufactured. The material of the metal tube was SUS304, an austenitic stainless steel. Measurement of the surface roughness configuration was made using a surface roughness-profile measuring device Surfcom 130A by Tokyo Seimitsu (Tokyo, Japan).

Figure 7:
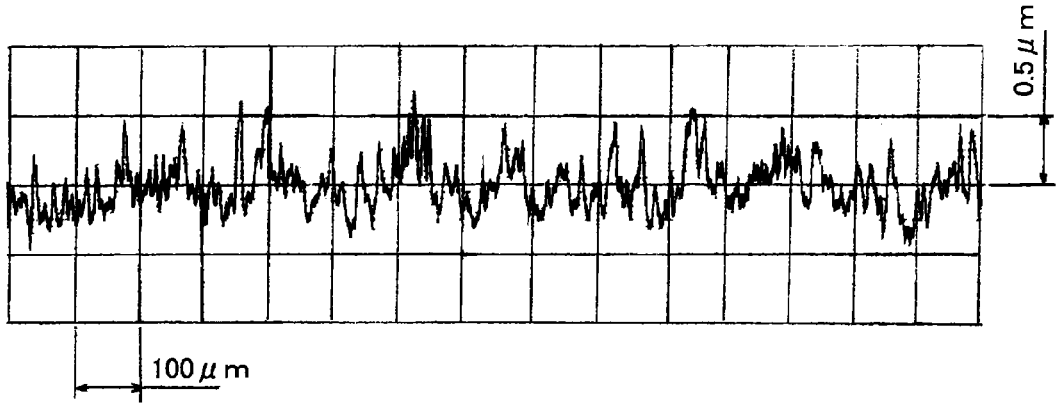
FIG. 7 is a data diagram illustrating a surface shape of a metal tube manufactured by conventional drawing.

FIG. 7 illustrates the results of the measurement of the surface configuration. The results show that in the conventional method for manufacturing a tube fine irregularities are not formed at a constant interval. Likewise, it was found that the conventional method for manufacturing a tube involved a greater number of processes and incurred higher costs than the manufacturing method according to the above-described embodiment.

While embodiments of the present invention have been described, the present invention is not limited thereto, as it is obvious that various modifications can be made without departing from the purpose and scope of the present invention.

INDUSTRIAL APPLICATION

The present invention can be used in the field of industry, such as printing machineries, printing apparatus, copiers, copying apparatus and the like, in the form of, for instance, fixing rollers, pressure rollers, photosensitive drums or the like of electrophotographic printers or copiers.

What is claimed is:

1. A tube, which is a hollow tube made of metal, having a uniform wall thickness of 20 to 50 μm and being obtained by plastic working through spinning, in which a metallic ring-shaped metal original body is rotated about the center axis thereof together with a rotation support body, while being pressed by a top or tops disposed on the outer periphery of said metal original body, wherein fine irregularities are formed on the outer peripheral face and the inner peripheral face of said metal tube at a substantially constant interval, wherein said irregularities are made of dimension difference between peaks and valleys on the outer peripheral face and the inner peripheral face, the dimension difference being about 1 μm, wherein said irregularities are formed in a pattern of multiple spirals in the center axis direction of said metal tube, wherein said tube is a tube for a fixing roller or for a belt used in an electrophotographic printer or a copier, wherein said fine irregularities of said inner peripheral face have a lubricant-holding capability.

2. A method for manufacturing a tube, the method comprising:

a step of mounting a metal original body of a plastic-workable metal on a rotation support body for working the metal original body to have an inner-outer surface configuration with fine irregularities at a substantially constant interval;

a step of subjecting said mounted metal original body to spinning, in which a wall thickness of a tubular portion of said metal original body is reduced to a uniform wall thickness of 20 to 50 μm while said metal original body is rotated about the center axis thereof together with said rotation support body and in which the inner-outer surface configuration of the metal original body becomes a surface with fine irregularities at a substantially constant interval; and a step of cutting both end portions of said metal original body, having been subjected to spinning, to yield a tube shape, wherein the surface with said fine irregularities is a surface having indentations of fine irregularities in a pattern of multiple spirals, wherein said irregularities are made of dimension difference between peaks and valleys on the surface, the dimension difference being about 1 μm, wherein said tube is a tube for a fixing roller or for a belt used in an electrophotographic printer or a copier, wherein said fine irregularities of said inner peripheral face have a lubricant-holding capability.

3. The method for manufacturing a tube according to claim 2, wherein a material of said metal original body is stainless steel.

* * * * *